US006252492B1

(12) United States Patent
Frank et al.

(10) Patent No.: US 6,252,492 B1
(45) Date of Patent: Jun. 26, 2001

(54) CONDITION-RESPONSIVE ELECTRIC SWITCH MECHANISM

(76) Inventors: James P. Frank, 1509 7th Ave., Rock Falls, IL (US) 61071; Ronald W. Poling; Ted P. Struttmann, both of 607 N. Orange, Morrison, IL (US) 61270

( * ) Notice: Subject to any disclaimer, the term of this patent is extended or adjusted under 35 U.S.C. 154(b) by 0 days.

(21) Appl. No.: 09/271,830

(22) Filed: Mar. 18, 1999

(51) Int. Cl.[7] ..... H01H 37/54; H01H 37/12; H01H 5/20

(52) U.S. Cl. ..... 337/365; 337/368; 337/319; 337/347; 337/375; 200/407; 200/448

(58) Field of Search ..... 337/365, 306, 337/309, 311, 318, 319, 320, 321, 322, 323, 327, 330, 332, 382, 383, 390, 393, 394, 396, 398, 400, 114, 115, 117, 119, 368, 343, 345, 347, 375; 200/406, 407, 448, 460, 461

(56) References Cited

U.S. PATENT DOCUMENTS

| | | | | |
|---|---|---|---|---|
| 2,121,079 | * | 6/1938 | Eskin | 337/313 |
| 2,250,437 | | 7/1941 | Persons | 200/83 |
| 2,489,906 | | 11/1949 | Kuhn | 177/311 |
| 2,591,803 | | 4/1952 | Garner | 200/140 |
| 2,598,563 | | 5/1952 | Konle et al. | 200/140 |
| 2,718,574 | | 9/1955 | Weber et al. | 200/140 |
| 2,755,360 | * | 7/1956 | Birk | 337/309 |
| 2,833,894 | * | 5/1958 | Weber et al. | 337/309 |
| 2,850,598 | | 9/1958 | Rauh | 200/140 |
| 3,018,345 | | 1/1962 | Gustafson | 200/67 |
| 3,065,320 | | 11/1962 | Cobean | 200/140 |
| 3,065,323 | | 11/1962 | Grimshaw | 200/140 |
| 3,098,903 | | 7/1963 | Anderson | 200/67 |
| 3,103,567 | | 9/1963 | Liebermann et al. | 200/140 |
| 3,103,568 | | 9/1963 | Liebermann et al. | 200/140 |
| 3,197,955 | | 8/1965 | Cohn et al. | 60/30 |
| 3,648,214 | | 3/1972 | Slonneger | 337/311 |
| 3,656,182 | | 4/1972 | Staples | 337/319 |
| 3,749,865 | | 7/1973 | Kalt et al. | 200/83 |
| 3,872,417 | | 3/1975 | Hufschmid | 337/365 |
| 4,166,268 | * | 8/1979 | Beck | 337/309 |
| 4,214,136 | | 7/1980 | Rossi et al. | 200/67 |
| 4,224,488 | | 9/1980 | Rossi | 200/67 |

(List continued on next page.)

FOREIGN PATENT DOCUMENTS

| | | | |
|---|---|---|---|
| 1575309 | 9/1976 | (GB) | H01H/37/70 |
| 2111203A | 6/1983 | (GB) | G01K/13/00 |
| 2123147A | 1/1984 | (GB) | G01K/11/04 |

*Primary Examiner*—Gerald Tolin
*Assistant Examiner*—Anatoly Vortman

(57) ABSTRACT

A condition-responsive electric switch mechanism for use in controlling a compressor of a refrigeration appliance. The switch mechanism includes first, second and third terminals, an actuator movable as a function of a detected condition and a bistable spring switch element electrically connected to the first terminal. The spring switch element includes a movable contact and is adapted for snap-acting movement between an open and a closed position. In the open position, the movable contact of the spring switch element is spaced apart from a fixed contact mounted on the second terminal. In the closed position, the movable contact engages the fixed contact to electrically connect the first and second terminals. The spring switch element also includes a toggle blade operable by engagement with the actuator for motion through a first switch point. At the first switch point, the spring switch element snaps between the open and closed positions. The toggle blade is operable by further engagement with the actuator for motion past the first switch point to a second switch point. At the second switch point, the toggle blade electrical connects the first and third terminals to enable an alarm.

20 Claims, 6 Drawing Sheets

U.S. PATENT DOCUMENTS

| | | | |
|---|---|---|---|
| 4,346,564 | 8/1982 | Gemma et al. | 62/140 |
| 4,490,708 | 12/1984 | Thompson et al. | 337/320 |
| 4,500,760 | 2/1985 | Malbec et al. | 200/83 |
| 4,510,480 | 4/1985 | Rossi et al. | 337/321 |
| 4,510,765 | 4/1985 | Rossi | 62/154 |
| 4,937,549 | 6/1990 | Kelly et al. | 337/309 |
| 5,003,282 | 3/1991 | Boulanger | 337/348 |
| 5,101,188 | 3/1992 | Kelly et al. | 337/309 |
| 5,142,261 | 8/1992 | Fuller et al. | 337/115 |
| 5,585,774 | 12/1996 | Bennett | 337/365 |
| 5,617,070 | 4/1997 | Bodnar | 337/323 |

* cited by examiner

CONDITION-RESPONSIVE ELECTRIC SWITCH MECHANISM

BACKGROUND OF THE INVENTION

This invention relates generally to condition-responsive controls and, particularly, to a condition-responsive electric switch mechanism having an alarm or an alarm and line switch.

Switches that are responsive to temperature changes, commonly known as thermostats or cold controls, are used in refrigeration appliances, such a refrigerators and freezers, to control the temperatures therein. These thermostats regulate the switching cycle of the refrigeration compressor in response to the temperature of the air contained at some location within the appliance. When the temperature exceeds a certain "turn-on" point, the switch contacts are closed and the compressor is switched on to cool the appliance. When the temperature drops below a certain "turn-off" point, the switch contacts are opened and the compressor is switched off.

Thermostats of the type to which this invention relates typically employ a bellows communicating with a capillary tube in thermal contact with the location to be cooled. Expansion and contraction of a gas within the capillary tube and bellows causes corresponding expansion and contraction of the length of the bellows. The motion of the bellows is transmitted via an actuator to a switch element such as a bistable spring switch element which is capable of snapping between two stable positions, one of which closes a circuit and activates the compressor to cool the appliance and the other of which opens the circuit to deactivate the compressor. The spring switch element is fixed to one circuit element and extends outwardly toward another circuit element and carries a electrical contact on its free end. In the circuit open position of the spring switch element, the spring switch element is spaced away from the other circuit element. In the circuit closed position, the contact on the spring switch element engages a contact fixed to the other circuit element and the circuit is completed. Snapping of the spring switch element is controlled by the actuator in the thermostat which presses against the spring switch element with a force increasing with the increase in temperature above the set point detected within the appliance. Eventually, the force reaches a switch point at which the spring switch element snaps from one position to another to open or close the circuit.

Under certain circumstances, the temperature in an appliance compartment, for example, can continue to rise above the temperature set point even though the cold control has called for the compressor to cool the compartment. In these instances, an audio or visual indication of the excessive temperature condition is desired. Unfortunately, presently available alarm circuits require an increase in force to close the alarm circuit and cause additional electrical loading during closure of the circuit. This prevents the user from calibrating the alarm threshold temperature very closely to the thermostat's temperature set point for turning on the compressor.

Commonly assigned U.S. Pat. Nos. 3,065,320, 3,065,323, 3,648,214, 4,490,708, 5,142,261 and 5,585,774, the entire disclosures of which are incorporated herein by reference, are examples of thermostats for refrigeration appliances.

SUMMARY OF THE INVENTION

It is therefore seen to be desirable to provide responsive electric switch mechanism that permits temperature control of a compressor; such a switch mechanism generates an alarm signal when a detected temperature exceeds a threshold; the provision of such a switch mechanism that permits substantial sensitivity adjustment of the mechanism by changing the gap between fixed and movable contacts; and such a switch mechanism that is economically feasible and commercially practical.

Briefly described, a condition-responsive electric switch mechanism embodying aspects of the invention includes a housing with first, second and third terminals projecting outwardly from the housing for connection in an external electric circuit. The switch mechanism also includes an actuator movable as a function of a detected condition and a bistable spring switch element electrically connected to the first terminal. The spring switch element includes a movable contact and is adapted for snap-acting movement between a circuit open position and a circuit closed position. In the circuit open position, the movable contact of the spring switch element is spaced apart from a fixed contact mounted on the second terminal. In the circuit closed position, the movable contact engages the fixed contact to electrically connect the first and second terminals. The spring switch element also includes a toggle blade operable by engagement with the actuator for motion through a first switch point. At the first switch point, the spring switch element snaps between the circuit open position and the circuit closed position. The toggle blade is operable by further engagement with the actuator for motion past the first switch point to a second switch point for electrically connecting the first and third terminals.

In one embodiment of the invention, the condition-responsive switch mechanism is adapted for use with a refrigeration appliance. The appliance includes a compartment and a compressor for cooling the compartment. The appliance also includes an alarm and the switch mechanism is responsive to temperature in the compartment for controlling operation of the compressor.

Alternatively, the invention may comprise various other methods or systems.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF PREFERRED EMBODIMENTS

Figure 1:
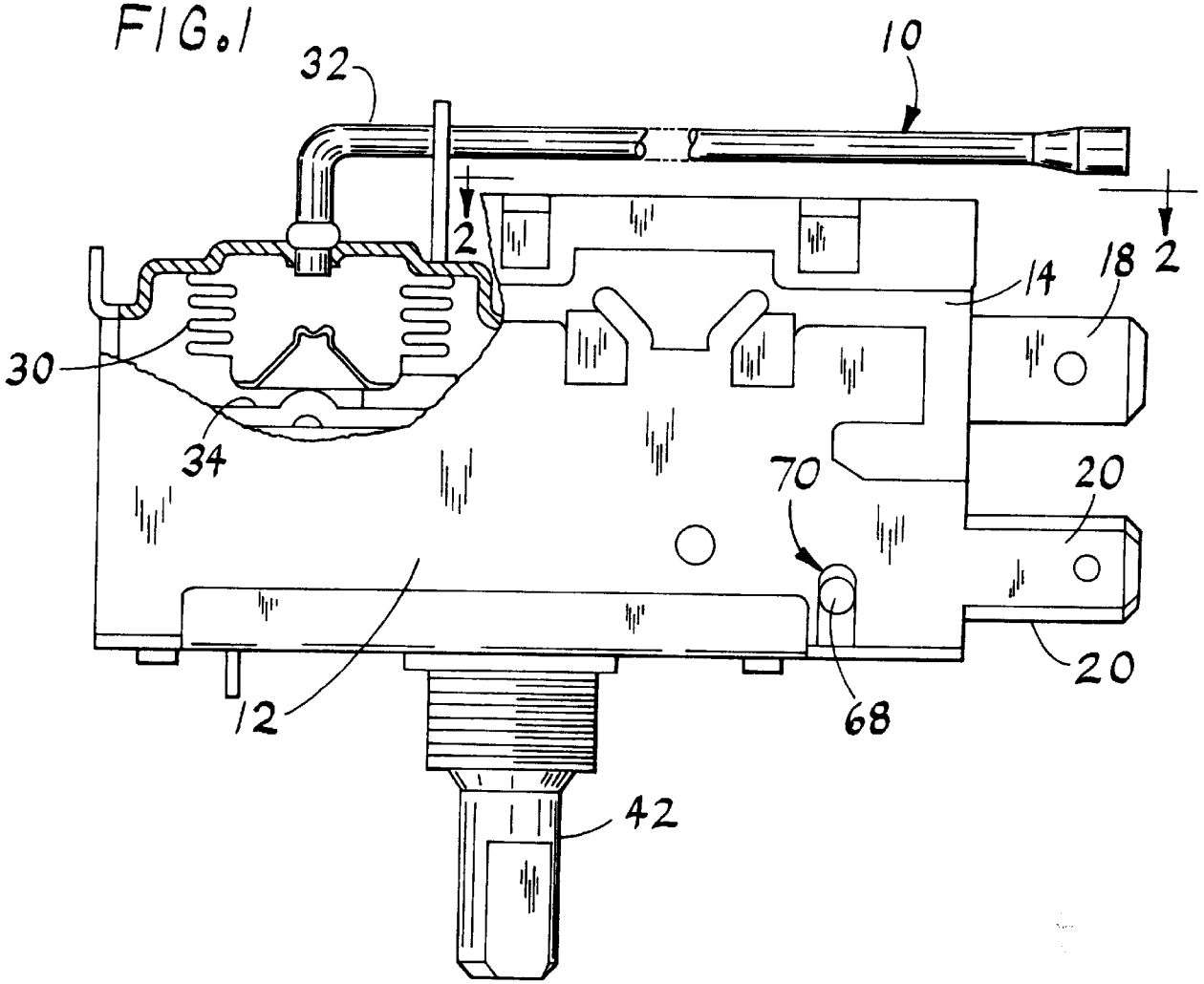
FIG. 1 is an elevation of a condition responsive electric switch mechanism with parts broken away to show internal construction.

Referring now to the drawings, FIGS. 1–5 show a condition-responsive electric switch mechanism, generally indicated at 10, embodying aspects of the invention. As an example, the switch mechanism 10 responds to a temperature condition and is commonly referred to as a thermostat or cold control device for use in a refrigeration appliance. Switch mechanism 10 has a housing, generally indicated at 12, that includes an insulated housing portion 14 mounting a first terminal 16 and a second terminal 18. In one embodiment of the invention, the terminals 16, 18 are metal blades projecting outwardly from the housing portion 14 for plug-in connection to an electric circuit such as a power circuit for a compressor (see FIG. 7). The housing 12 also includes a pair of ground terminals 20.

Actuation of a bistable spring switch element, indicated generally at 22, selectively opens and closes the circuit between first and second terminals 16, 18. As shown, the spring switch element 22 is fixedly connected to the first terminal 16 and carries a movable contact 24 that is selectively engageable with a fixed contact 26 on the second terminal 18.

In one preferred embodiment of the invention, a bellows 30 connected to a capillary tube 32 cooperate to actuate spring switch element 22 in response to temperature conditions. The bellows 30 and capillary tube 32 are charged with an operating fluid, such as a refrigerant gas, that expands and contracts as the temperature changes in, for example, an appliance compartment. Bellows 30 expands and contracts in an axial direction in correspondence with the vapor pressure changes of the operating fluid within it and the movement is transmitted by an actuator link 34 to a switch actuator 36. The switch actuator 36 engages spring switch element 22 for actuating it between the circuit open and circuit closed positions. In the illustrated embodiment, switch actuator 36 is an outwardly extending projection on the actuator link 34 on the opposite side of a pivot point (not shown) from where bellows 30 engages link 34. A spring 38 mounted in housing 12 and connected directly or indirectly to actuator link 34 urges actuator link 34 to pivot in opposite directions. By adjusting spring 38, a user can adjust the force necessary to move switch actuator 36 and, thus adjust the temperature set point (in the context of a refrigerator or freezer appliance). A screw 40 is provided for making the initial tension settings of spring 38. During operation, the user can adjust the set point by a cam shaft 42 extending out of the housing 12.

In the present invention, the bellows 30, actuator link 34, switch actuator 36, adjustment mechanism (e.g., spring 38), spring switch element 22 and other components are all assembled, and the switch mechanism 10 is calibrated before the capillary tube 32 is connected.

Figure 3:
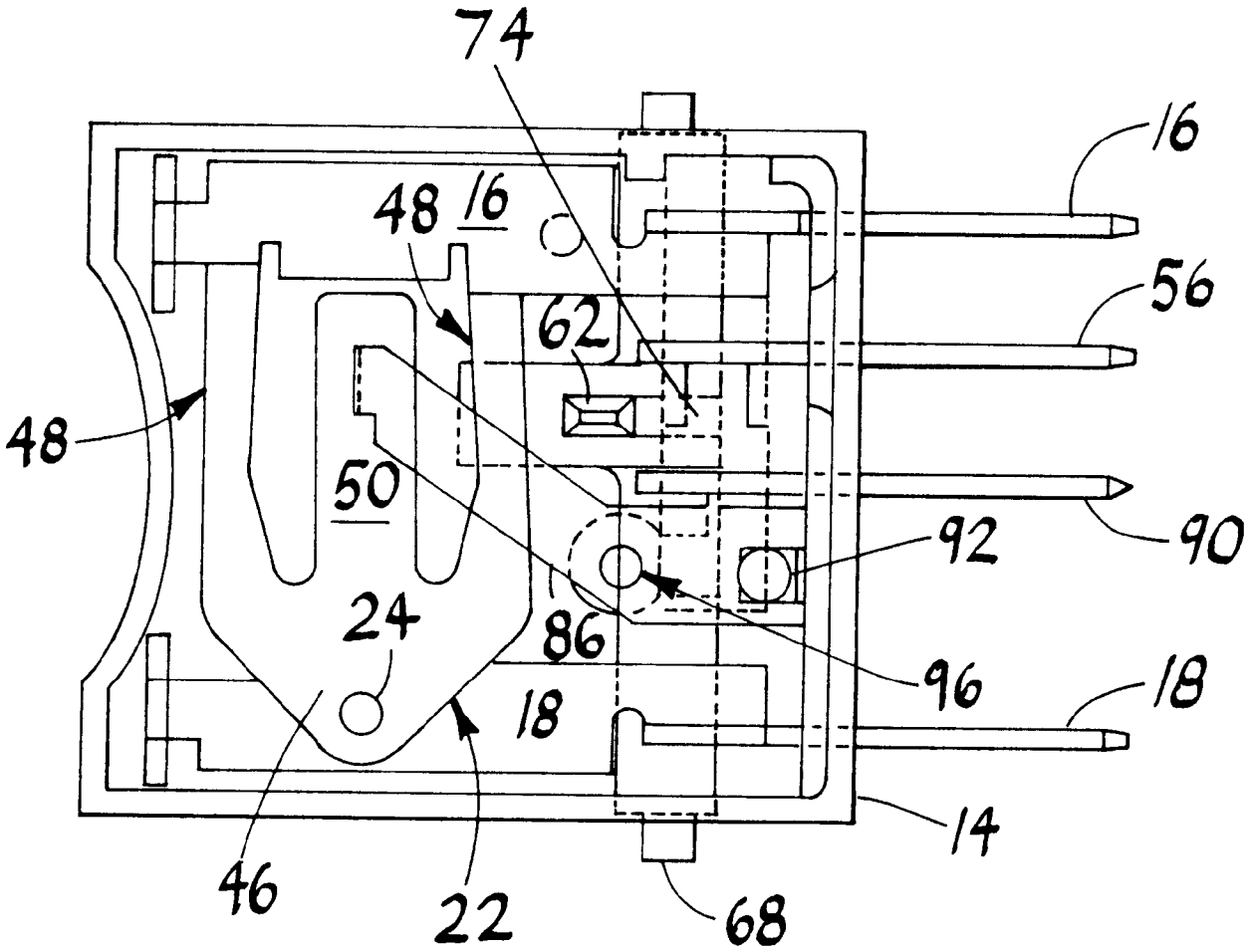
FIG. 3 is a cross section taken in the plane of line 3—3 of FIG. 2 with parts removed to show details.
Figure 4:
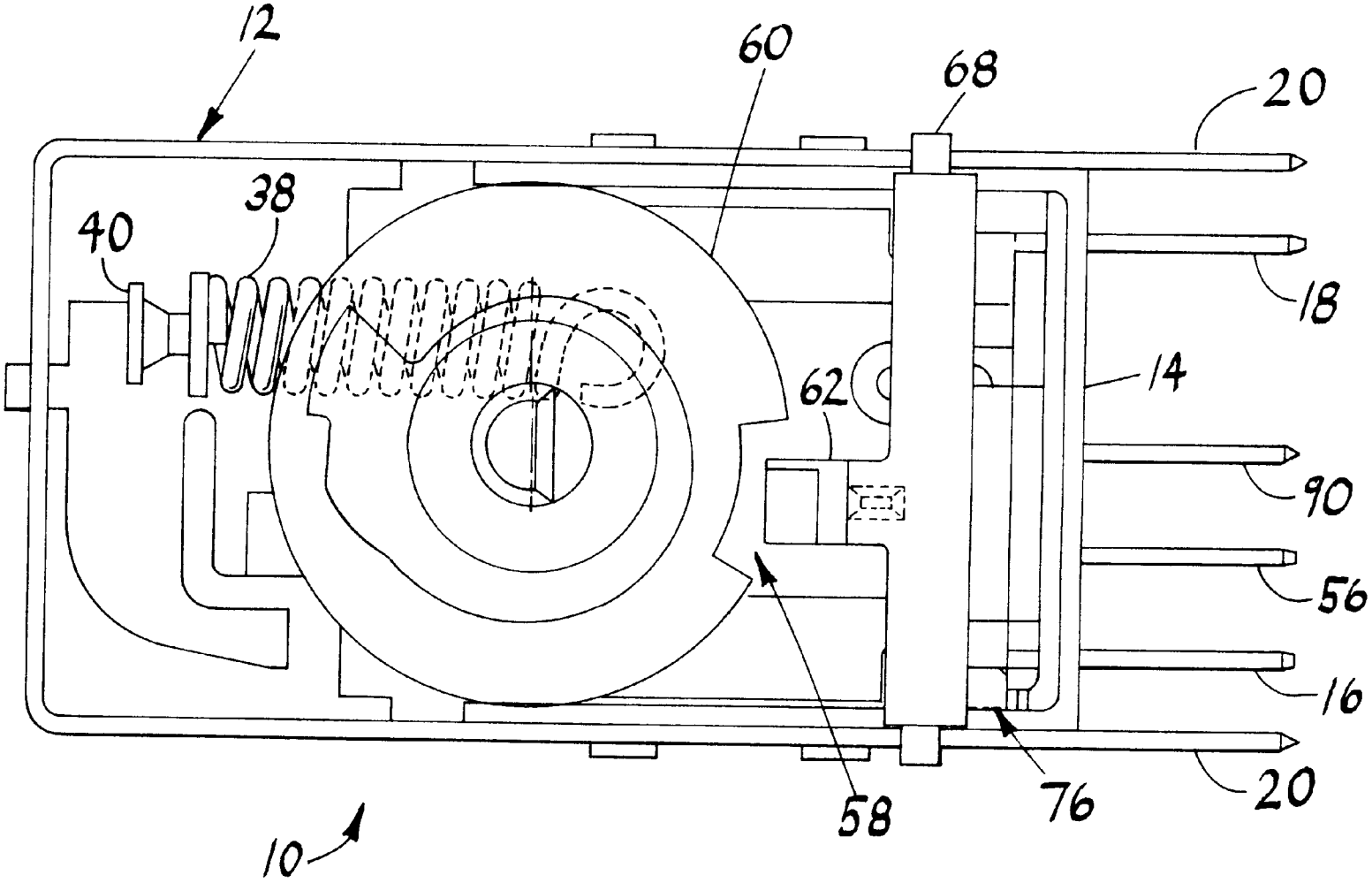
FIG. 4 is a cross section taken in the plane of line 4—4 of FIG. 2 with parts removed to show details.

As shown in FIG. 3, spring switch element 22 includes a head 46 on which the movable contact 24 is mounted. In addition, spring switch element 22 has a pair of arms, each indicated generally at 48, extending outwardly from the head 46. A toggle blade, or tongue, 50 extends outwardly from head 46 from a location between the arms 48. Preferably, a single piece of a suitable electrically conductive material (e.g., beryllium copper) forms the head 46, arms 48 and toggle blade 50 of spring switch element 22. The spring switch element 22, as assembled in switch mechanism 10, is adapted for snap-acting movement between two configurations, convex and concave, corresponding to the circuit open and circuit closed positions, respectively. As bellows 30 expand and contract, switch actuator 36 engages and moves toggle blade 50. In the present embodiment, increasing temperatures in the appliance cause the bellows 30 to expand and move the toggle blade 50 upward in FIG. 5 and decreasing temperatures cause the bellows to contract moving the toggle blade downward in FIG. 5. Commonly assigned U.S. Pat. No. 5,585,774, the entire disclosure of which is incorporated herein by reference, describes the operation of bistable spring switch element 22 in detail.

The toggle blade 50 of spring switch element 22 lies generally in the plane of head 46 except at its distal end, which is formed with a bump 52 for engagement by actuator 36. Toggle blade 50 is preferably made as long as possible within the confines of the overall switch mechanism 10 dimensions and is constructed and arranged in switch mechanism 10 for engagement by switch actuator 36 as near to its distal end as possible. Other switch features known to those of ordinary skill in the art and not directly pertinent to the scope of the present invention, may also be added.

Figure 5:
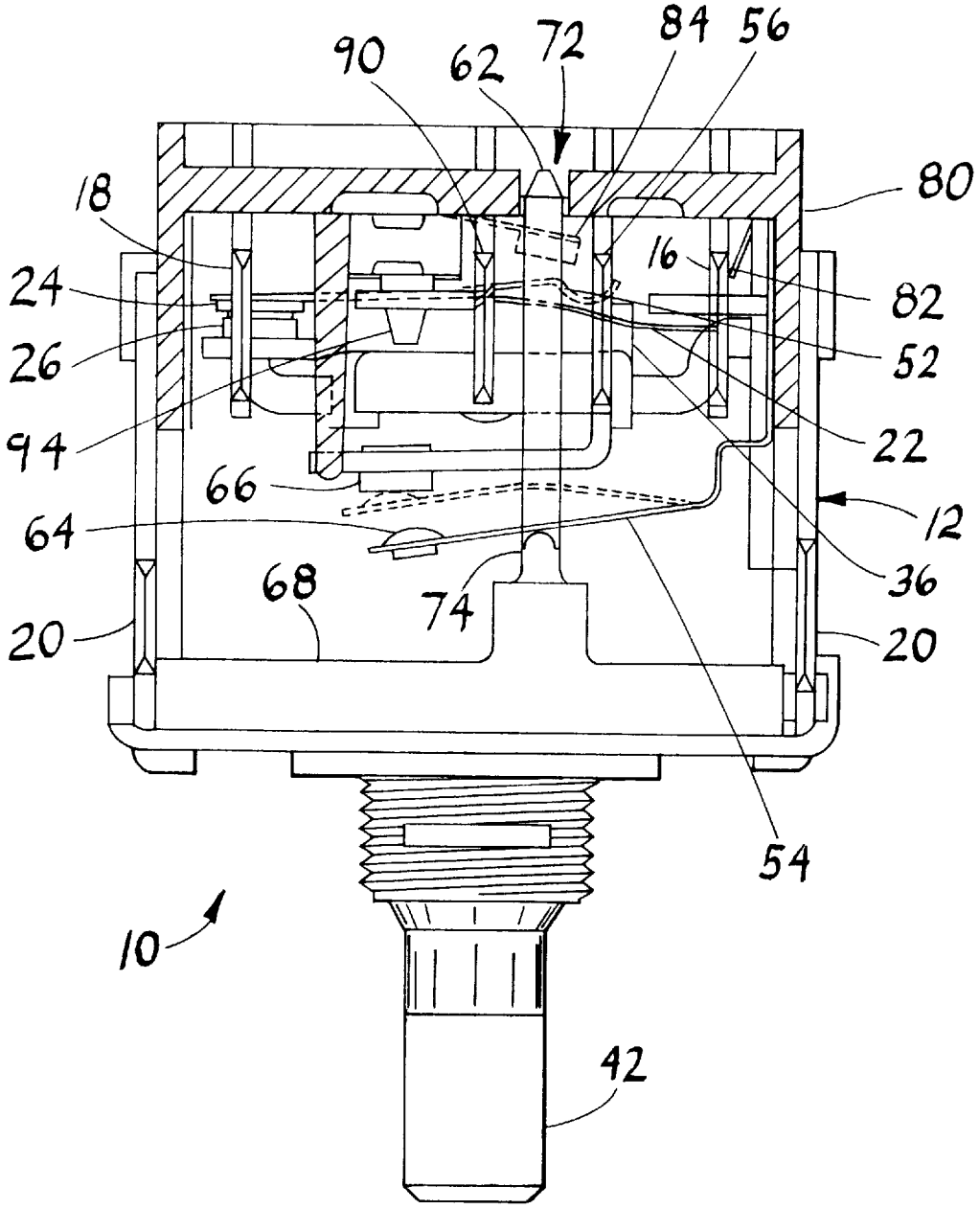
FIG. 5 is a cross section taken in the plane of line 5—5 of FIG. 2 with parts removed to show details.

In a preferred embodiment, condition-responsive electric switch mechanism 10 also includes a line disconnect circuit for selectively disabling switch mechanism 10 (e.g., to turn off the refrigerator). As shown in FIG. 5, a second switch element, such as a movable contact blade 54, extends between the first terminal 16 and a line terminal 56. The user operates the line disconnect circuit by rotating the cam shaft 42 to an "OFF" position. In the "OFF" position, an opening, indicated generally at 58, on a flange 60 allows a push rod 62 to move away from the movable contact blade 54. As a result, a movable contact 64 disengages from a fixed contact 66 to open the circuit. An axle 68, positioned in frame slots, generally indicated at 70, guides the push rod 62. The other end of push rod 62 is located in housing portion 14 by a slot, generally indicated at 72. A finger 74 on push rod 62 contacts movable contact blade 54, which forces push rod 62 away from the movable contact 64 to allow contacts 64, 66 to disengage. Rotating cam shaft 42 in the opposite direction causes the flange 60 to engage push rod 62. In turn, flange 60 moves push rod 62 toward contact 64 thereby reconnecting the line circuit (shown in phantom).

During assembly, movable contact blade 54 is inserted into its final position by placing it in the open end of a channel, indicated generally at 76, and pushing it toward terminal 16. As movable contact blade 54 moves past terminal 16, a contact force is created by collapsing a "U" spring 80 and continuity established by two barbs 82 pressing against terminal 16.

According to a preferred embodiment of the invention, condition-responsive electric switch mechanism 10 includes an alarm circuit for providing an electrical alarm signal indicating that the temperature in the refrigerator or freezer has risen above a threshold level. As described above, the thermostat's bellows 30 cause actuator 36 to deflect when the temperature rises above a threshold level (i.e., the temperature set point). If the temperature in the appliance compartment continues to rise above the threshold, even after switch mechanism 10 causes the compressor to turn on, actuator 36 forces the toggle blade 50 of spring switch element 22 into contact with a tab 84 on an alarm contact blade 86. This completes the circuit for generating the alarm signal. An alarm terminal 90 connected to the alarm contact blade 86 provides a connection to an audio and/or visual alarm.

During assembly, alarm contact blade 86 is positioned on a base post 92. As the alarm terminal 90 is mounted on housing portion 14, another tab 94 on alarm contact blade 86 is located in an alarm terminal hole, indicated generally at 96. This establishes continuity between alarm contact blade 86 and alarm terminal 90 and prevents alarm contact blade 86 from rotating.

Figure 2:
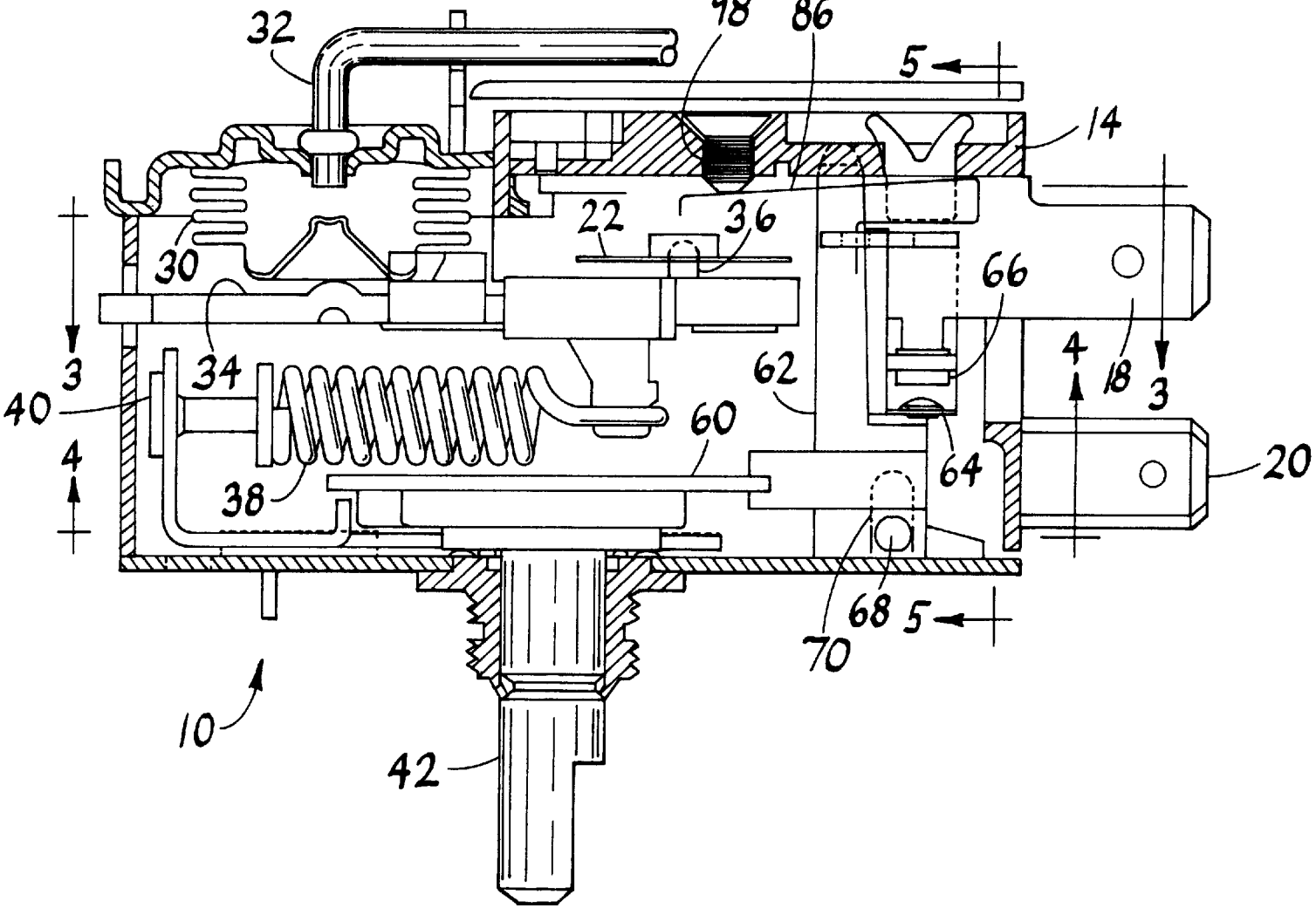
FIG. 2 is a cross section taken in the plane of line 2—2 of FIG. 1 with parts removed to show details.

As shown in FIG. 2, a gap set screw 98 threadably mounted in the insulated housing portion 14 of switch mechanism 10 engages alarm contact blade 86 to set its spacing from actuator 36. Narrowing the gap increases the sensitivity of the alarm circuit and increasing the gap decreases the sensitivity. Advantageously, alarm contact blade 86 permits the user to calibrate the alarm threshold temperature very closely to the thermostat's temperature set point for turning on the compressor because there is no increase in force required to close the alarm circuit. Further, no significant additional mechanical load is picked up during closure of the alarm circuit. As an example, the alarm gap (from compressor "ON" to alarm "ON") can be as small as about 0.1 mm.

Figure 6:
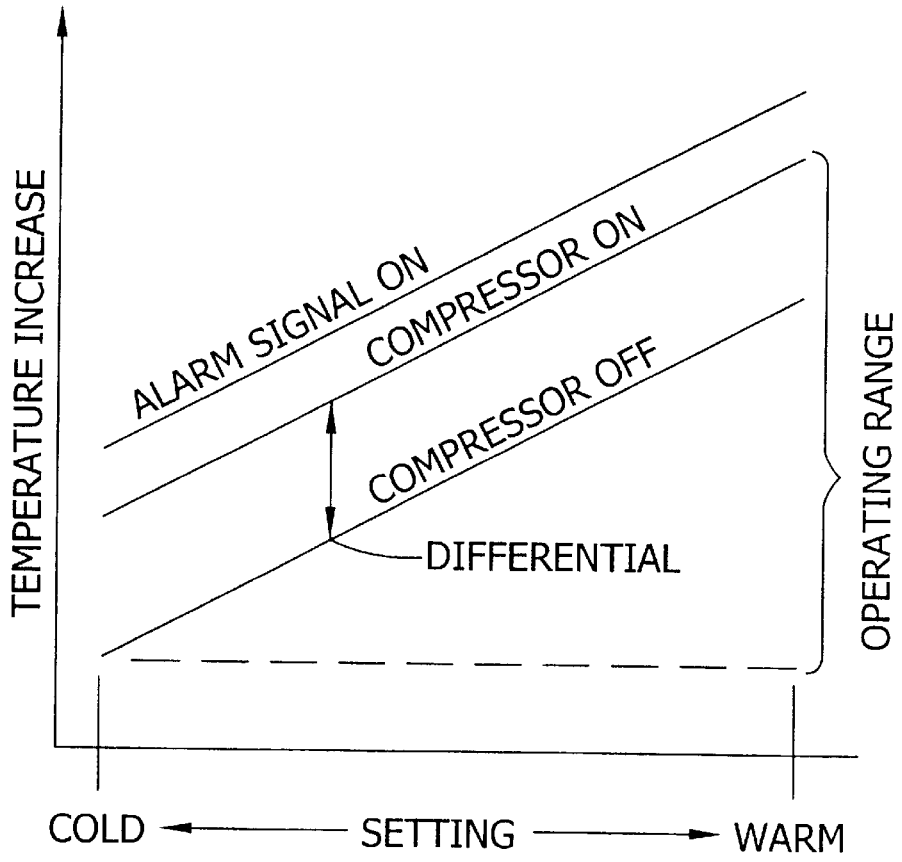
FIG. 6 is a diagram of an exemplary operating range of the condition responsive switch of FIG. 1.

Referring now to FIG. 6, the user preferably turns a knob (not shown) mounted on cam shaft 42 to define the operating range of switch mechanism 10. The user selects the temperature at which the compressor will turn on and will turn off within a range of temperatures (from COLD to WARM). For example, the user can select a setting from about −24.0±2.0° C. to about −11.0±1.0° C. for switch mechanism 10 to turn on the compressor when the temperature in the appliance compartment rises to the "ON" set point. The corresponding temperature range for turning off the compressor is about −33.0±2.0° C. to about −17.0±1.0° C. when the temperature in the appliance compartment falls below the "OFF" set point. In this example, the differential between the "ON" and "OFF" set points is approximately constant. Under certain circumstances, the temperature being controlled by condition-responsive electric switch mechanism 10 may continue to rise even though the switch mechanism 10 instructed the compressor to turn on (e.g., inadequate refrigerant in the compressor). Advantageously, the alarm circuit of the present invention generates an electrical alarm signal when the temperature in the appliance compartment exceeds the "ON" set point by a predetermined amount. In this example, the alarm set point is between about −18.5±1.5° C. and about −7.5±1.5° C.

Figure 7:
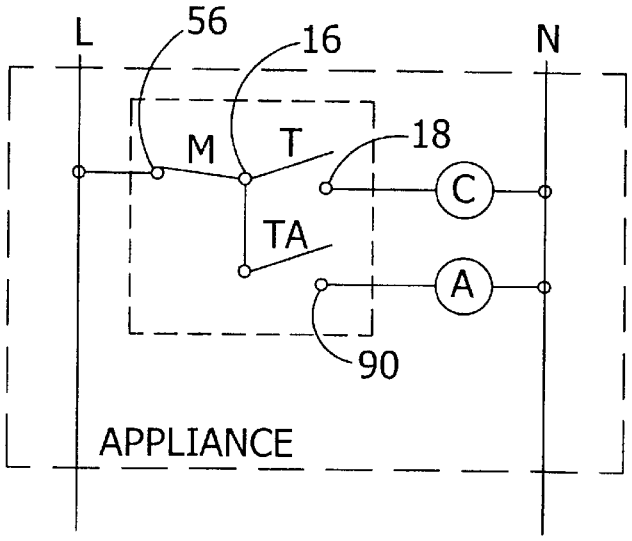
FIG. 7 is a schematic wiring diagram of the condition responsive switch of FIG. 1.

FIG. 7 provides a simplified schematic wiring diagram of switch mechanism 10. In the diagram, T represents a thermal switch that closes on temperature rise for turning on a compressor C and TA represents another thermal switch that closes on temperature rise for turning on an alarm A. Reference character M indicates a manual switch for providing a line disconnect. Advantageously, the present invention provides a direct electrical connection in which actuator 36 forces the switch toggle blade 50 directly into electrical contact with alarm contact blade 86. This feature permits the user to calibrate the alarm threshold temperature very closely to the threshold temperature for turning on the compressor C because there is no increase in force required to close the alarm circuit for generating the alarm signal for the alarm A.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A condition-responsive electric switch mechanism comprising:

a housing;

first, second and third terminals projecting outwardly from the housing for connection in an external electric circuit, said second terminal having a fixed contact mounted thereon;

an actuator movable as a function of a detected condition;

a bistable spring switch element electrically connected to the first terminal, said spring switch element including a movable contact and being adapted for snap-acting movement between a circuit open position in which the movable contact of the spring switch element is spaced apart from the fixed contact of the second terminal and a circuit closed position in which the movable contact of the spring switch element engages the fixed contact of the second terminal to electrically connect the first and second terminals, said spring switch element including a toggle blade operable by engagement with the actuator for motion through a first switch point at which the spring switch element snaps between the circuit open position and the circuit closed position, said toggle blade being operable by further engagement with the actuator for motion past the first switch point to a second switch point for electrically connecting the first and third terminals, said first and second terminals forming a line circuit when the spring switch element is in its circuit closed position; and a line disconnect circuit electrically in series with the line circuit, said line disconnect circuit selectively disconnecting the line circuit from a power supply for disabling the external electrical circuit, and wherein the line disconnect circuit comprises a fourth terminal projecting outwardly from the housing, said fourth terminal having a fixed contact mounted thereon.

2. The condition-responsive switch mechanism of claim 1 wherein the line disconnect circuit comprises a second switch element electrically connected to the first terminal, said second switch element including a movable contact and being adapted for movement between a circuit open position in which the movable contact of the second switch element is spaced apart from the fixed contact of the fourth terminal and a circuit closed position in which the movable contact of the second switch element engages the fixed contact of the fourth terminal to electrically connect the first and fourth terminals, and wherein the line circuit is disconnected from the power supply when the second switch element is in its circuit open position.

3. The condition-responsive switch mechanism of claim 2 further comprising a rod for selectively biasing the movable contact of the second switch element into the circuit closed position with the fixed contact of the fourth terminal blade.

4. The condition-responsive switch mechanism of claim 1 wherein the detected condition is temperature and wherein the first switch point corresponds to a first temperature threshold.

5. The condition-responsive switch mechanism of claim 4 wherein the second switch point corresponds to a second temperature threshold greater than the first temperature threshold.

6. The condition-responsive switch mechanism of claim 4 wherein the distance between the first and second switch points of the toggle blade defines an alarm gap, said alarm gap corresponding to a predetermined temperature difference exceeding the first temperature threshold.

7. The condition-responsive switch mechanism of claim 1 wherein the external electrical circuit comprises a compressor electrically connected to the first and second terminals and an alarm electrically connected to the first and third terminals.

8. The condition-responsive switch mechanism of claim 1 being adapted for use with a refrigeration appliance, said refrigeration appliance including a compartment, a compressor for cooling the compartment and an alarm, wherein the detected condition is temperature in the compartment of the refrigeration appliance, wherein the first and second terminals are adapted to be electrically connected to the compressor and the first and third terminals are adapted to be electrically connected to the alarm, and wherein the movable contact of the spring switch element engages the fixed contact of the second terminal in the circuit closed position to electrically connect the first and second terminals for enabling the compressor.

9. The condition-responsive switch mechanism of claim 8 wherein the first switch point corresponds to a first temperature threshold representative of a desired temperature in the compartment of the refrigeration appliance.

10. The condition-responsive switch mechanism of claim 9 wherein the second switch point corresponds to a second temperature threshold greater than the first temperature threshold.

11. The condition-responsive switched mechanism of claim 8 wherein the first and second terminals form a line circuit when the spring switch element is in its circuit closed position and further comprising a line disconnect circuit electrically in series with the line circuit, said line disconnect circuit selectively disconnecting the line circuit from a power supply for disabling the compressor.

12. The condition-responsive switch mechanism of claim 8 wherein the distance between the first and second switch points of the toggle blade defines an alarm gap, said alarm gap corresponding to a predetermined temperature difference in the compartment of the refrigeration appliance exceeding the first temperature threshold.

13. The condition-responsive electric switch mechanism of claim 1 wherein the spring switch element maintains the circuit closed position electrically connecting the first and second terminals when the toggle blade moves past the first switch point toward the second switch point.

14. The condition-responsive electric switch mechanism of claim 1 further comprising a contact blade extending from the third terminal, said contact blade defining the second switch point, and wherein the toggle blade engages the contact blade to electrically connect the first and third terminals when the toggle blade reaches the second switch point.

15. The condition-responsive electric switch mechanism of claim 14 wherein the third terminal includes an opening for receiving and engaging a first the contact blade whereby the contact blade is retained in a desired position.

16. The condition-responsive electric switch mechanism of claim 14 wherein the toggle blade and contact blade are arranged for engagement with each other generally at a distal end of the toggle blade and a distal end of the contact blade.

17. The condition-responsive electric switch mechanism of claim 16 wherein the toggle blade has a bump at its distal end disposed for engagement by the actuator and wherein the contact blade has a tab at its distal end disposed for engagement by the toggle blade generally opposite the bump.

18. A condition-responsive electric switch mechanism for use with a refrigeration appliance, said refrigeration appliance including a compartment, a compressor for cooling the compartment and an alarm, said condition-responsive electric switch mechanism comprising:

a housing;

first, second and third terminals projecting outwardly from the housing for connection in an external electric circuit, said first and second terminals being adapted to be electrically connected to the compressor and said first and third terminals being adapted to be electrically connected to the alarm, said second terminal having a fixed contact mounted thereon;

an actuator movable as a function of the temperature in the compartment of the refrigeration appliance;

a bistable spring switch element electrically connected to the first terminal, said spring switch element including a movable contact and being adapted for snap-acting movement between a circuit open position and a circuit closed position, said movable contact of the spring switch element being spaced apart from the fixed contact of the second terminal in the circuit open position and said movable contact of the spring switch element engaging the fixed contact of the second terminal to electrically connect the first and second terminals for enabling the compressor in the circuit closed position, said spring switch element including a toggle blade operable by engagement with the actuator for motion through a first switch point at which the spring switch element snaps between the circuit open position and the circuit closed position, said toggle blade being operable by further engagement with the actuator for motion past the first switch point to a second switch point for electrically connecting the first and third terminals, said first and second terminals forming a line circuit when the spring switch element is in its circuit closed position; and a line disconnect circuit electrically in series with the line circuit, said line disconnect circuit selectively disconnecting the line circuit from a power supply for disabling the compressor, and wherein the line disconnect circuit comprises a fourth terminal projecting outwardly from the housing, said fourth terminal having a fixed contact mounted thereon.

19. The condition-responsive switch mechanism of claim 18 wherein the line disconnect circuit comprises a second switch element electrically connected to the first terminal, said second switch element including a movable contact and being adapted for movement between a circuit open position in which the movable contact of the second switch element is spaced apart from the fixed contact of the fourth terminal and a circuit closed position in which the movable contact of the second switch element engages the fixed contact of the fourth terminal to electrically connect the first and fourth terminals, and wherein the line circuit is disconnected from the power supply when the second switch element is in its circuit open position.

20. The condition-responsive switch mechanism of claim 19 wherein the switch mechanism includes a rod for selectively biasing the movable contact of the second switch element into the circuit closed position with the fixed contact of the fourth terminal blade.

* * * * *